United States Patent [19]

Palumbo

[11] 4,164,827

[45] Aug. 21, 1979

[54] ACTION TOY

[75] Inventor: Nunzio Palumbo, Hackensack, N.J.

[73] Assignee: Kohner, Inc., New York, N.Y.

[21] Appl. No.: 846,968

[22] Filed: Oct. 31, 1977

[51] Int. Cl.[2] ..... A63H 11/00

[52] U.S. Cl. ..... 46/119; 46/135 R; 40/425

[58] Field of Search ..... 46/119, 135 R, 126, 46/164, 118, 264, 265, 37, 36, 1 R, 120; 40/411, 416, 421, 425

[56] References Cited

U.S. PATENT DOCUMENTS

| | | | |
|---|---|---|---|
| 2,476,742 | 7/1949 | Lareau et al. | 46/37 |
| 2,620,593 | 12/1952 | Rockwood | 46/120 X |
| 2,968,121 | 1/1961 | Pearson, Jr. et al. | 46/118 |
| 2,969,610 | 1/1961 | Weiner | 46/37 X |

*Primary Examiner*—Russell R. Kinsey
*Assistant Examiner*—Mickey Yu
*Attorney, Agent, or Firm*—Seidel, Gonda, Goldhammer & Panitch

[57] ABSTRACT

An action toy comprising a housing in the shape of a face. The housing has two spaced openings which form the eyes of the face. A pair of plates are disposed within the housing in juxtaposition with the openings. Each plate bears an eyeball design. A pair of elastomeric hand-shaped members are rotatably mounted on opposite sides of the housing. Each hand-shaped member is secured to a hinge having a cam surface. Each hinge is spring biased to an open position. A motive member is connected to the plates and is provided with a pair of cams for causing simultaneous reciprocating movement of the plates and the hand-shaped members to simulate a peek-a-boo game.

15 Claims, 9 Drawing Figures

ACTION TOY

BACKGROUND OF THE INVENTION

The present invention is directed to an action toy. In particular, the invention is directed to an action toy in the shape of a face having movable eyes and a pair of hands which cover and uncover the eyes.

Action toys in the shape of a face having movable parts are known in the art. For example, see U.S. Design Pat. No. 233,900.

An advantage of the present invention is that the hands can be operated to cover and uncover the eyes to simulate a peek-a-boo game.

Another advantage of the invention is that the eyes can be made to move in a comical fashion.

A further advantage of the invention is that it provides visual as well as aural stimulation for a child.

Another advantage of the invention is that it is compact and portable.

Other advantages appear hereinafter.

BRIEF SUMMARY OF THE INVENTION

An action toy comprises a housing having at least one eye-shaped opening. A member bearing an eyeball design is disposed within the housing in juxtaposition with the opening. At least one hand-shaped member is rotatably mounted on the housing. A motive means causes simultaneous reciprocating movement of both members. An eyelid-shaped shutter is slidably mounted on the housing intermediate the opening and eyeball design member for reciprocating movement in juxtaposition with the opening.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
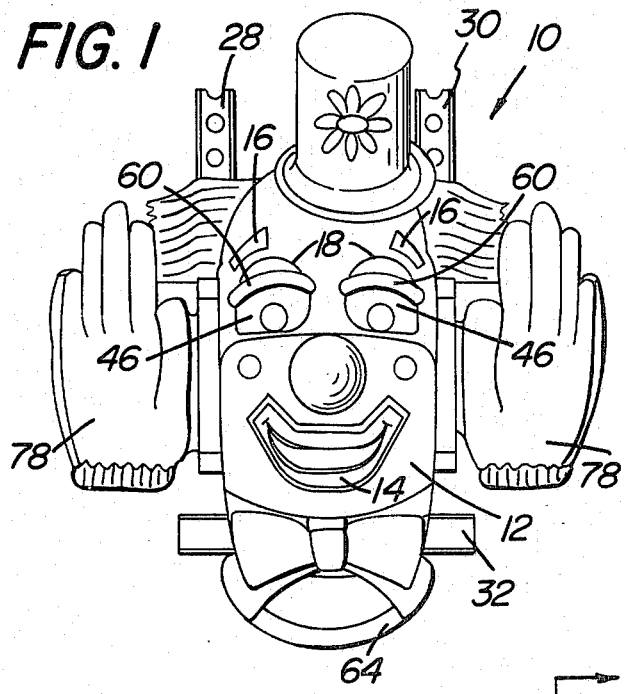
FIG. 1 is a front view of the invention.

Referring to the drawings in detail, wherein like numerals indicate like elements, there is shown in FIG. 1 an action toy 10 in accordance with the present invention. The action toy 10 includes a housing 12 in the shape of a face. The housing is provided with raised lips 14, eyebrows 16 and a pair of spaced eye-shaped openings 18. The spaced openings 18 represent the eyes of the face.

Figure 2:
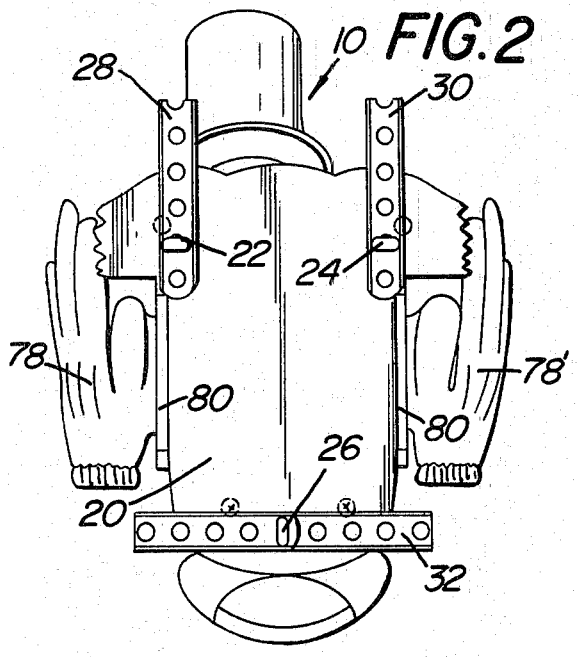
FIG. 2 is a rear view thereof.

A back panel 20 is screw fastened to the housing 12. See FIG. 2. The back panel 20 is provided with catches 22, 24 and 26 for retaining tie straps 28, 30 and 32 in position. The tie straps may be wrapped around the horizontal and vertical bars of a crib to anchor the action toy 10 in position.

Figure 3:
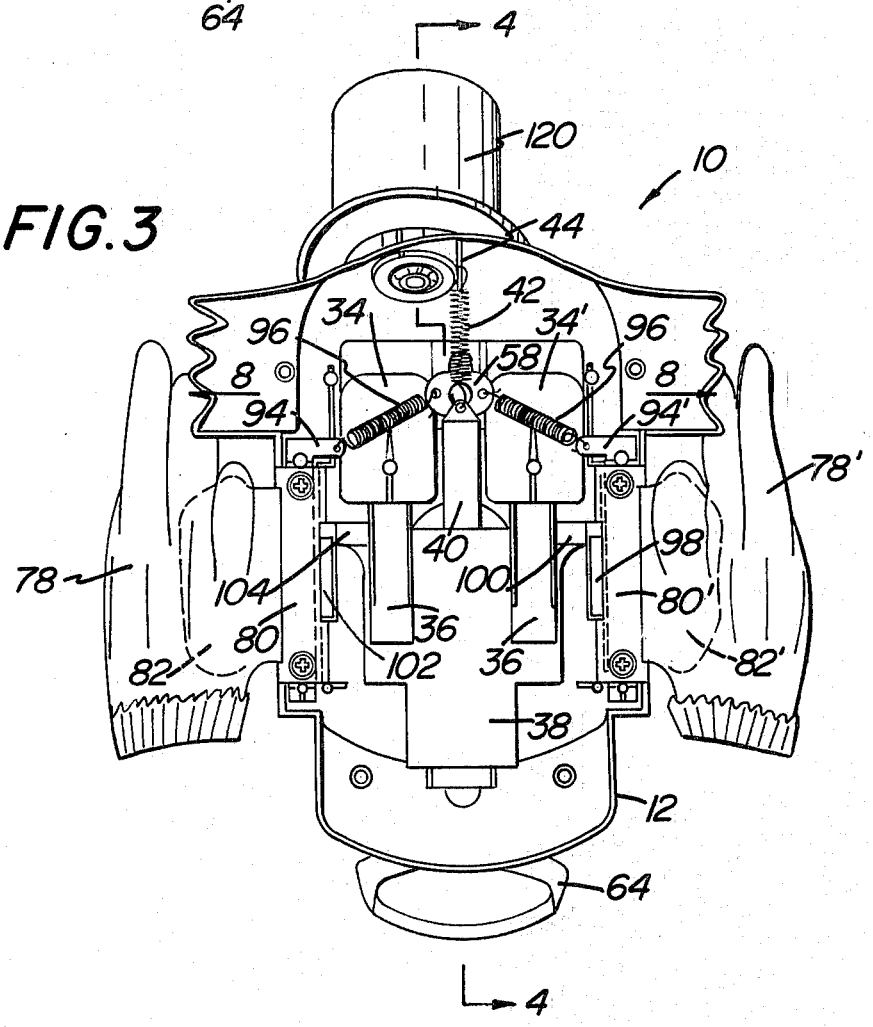
FIG. 3 is a rear view of the invention with the back panel removed.

A pair of plates 34, 34′ are connected via arms 36, 36′ respectively to a motive member 38. See FIG. 3. The motive member 38 has a tongue 40. The motive member 38 is coupled to the housing 12 by means of a spring 42 secured to the tongue 40 and a rib 44 on housing 12.

Cut-outs 46, 46′ having an eyeball design are secured to the fronts of plates 34, 34′ respectively by adhesive or the like. See FIG. 1. When spring 42 is in the retracted position, the cut-out designs appear in the position shown in FIG. 1.

Figure 8:
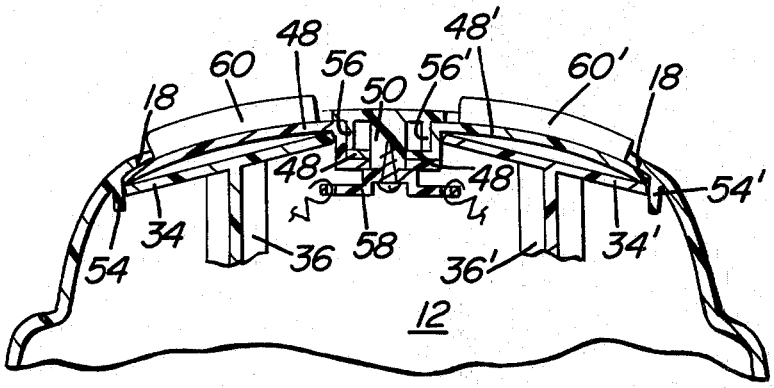
FIG. 8 is a cross-section taken along the lines 8—8 in FIG. 3.

A pair of eyelid-shaped shutters 48, 48′ are slideably mounted on a post 50 on housing 12. See FIGS. 4 and 8. The shutters are in juxtaposition with the pair of spaced openings 18 and are disposed between the openings and plates 34 and 34′. See FIG. 8. The post 50 extends through an elongated opening 52 in shutter 48 and elongated opening 52′ in shutter 48′. See FIG. 4. The shutters are retained in juxtaposition with the openings 18 by means of guide ribs 54, 56 and 54′, 56′. See FIG. 8. A retainer 58 is screw mounted on post 50 to press the shutters 48, 48′ flush against the housing 12. The shutters 48, 48′ are provided with arcuate ridges 60, 60′ which can be grasped by a child to raise and lower the shutters to simulate the opening and closing of eyelids.

Figure 4:
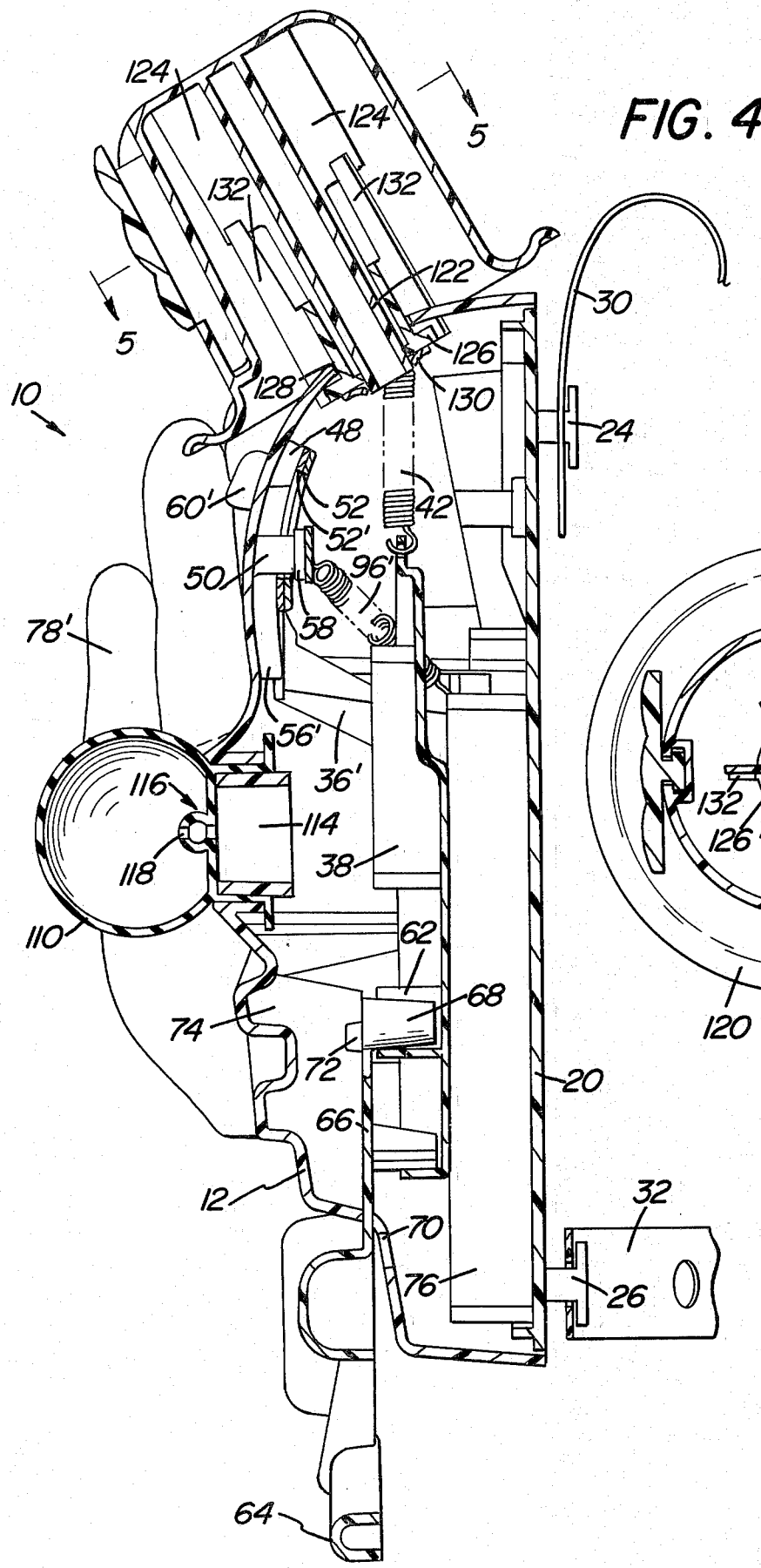
FIG. 4 is a cross-section taken along the lines 4—4 in FIG. 3.
Figure 5:
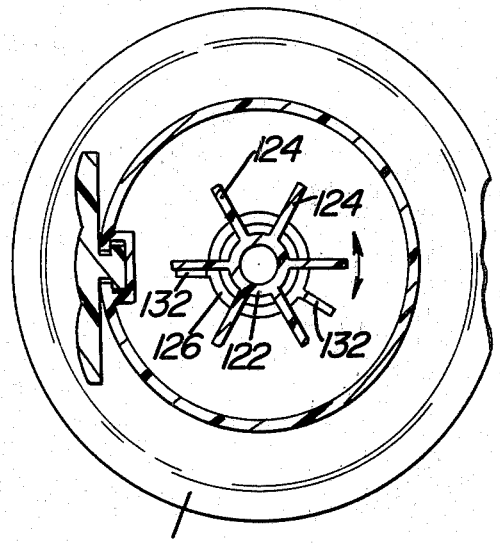
FIG. 5 is a cross-section taken along the lines 5—5 in FIG. 4.

Motive member 38 is provided with a U-shaped catch 62. See FIG. 4. A handle 64 has a tongue 66 and a finger 68 which is seated in the catch 62. Tongue 66 extends through an opening 70 in housing 12. The tongue has a pair of spaced fins 72 (only one of which is shown in FIG. 4). A rib 74 on housing 12 fits between the fins 72. The rib 74 slideably contacts tongue 66. The rib prevents tongue 66 and finger 68 from swinging away from motive member 38 when the handle 64 is pulled and released. Similarly, plural ribs 76 (only one of which is shown in FIG. 4) on housing 12 slideably contact motive member 38 to prevent the member from swinging away from tongue 66 and finger 68.

A child pulls the handle 64 to urge finger 68 against catch 62. Motive member 38 is drawn downwardly against the return force of spring 42. As a result, plates 34, 34′ travel downwardly in juxtaposition with the spaced openings 18. The eyeball designs on cut-outs 46, 46′ disappear from view producing the illusion of a comical eye movement. When the child releases the handle 64, the spring 42 snaps motive member 38 back to its original position. The plates 34, 34′ travel upwardly in juxtaposition with the spaced openings 18, and the eyeball designs on cut-outs 46, 46′ reappear. Thus, by pulling and releasing handle 64, the plates 34, 34′ are caused to reciprocate vertically in juxtaposition with the openings 18.

A pair of hand-shaped elastomeric members 78, 78′ are secured to hinges 80, 80′ by means of relatively rigid connecting members 82, 82′, respectively. See FIG. 3. The hinges 80, 80′ are rotatably mounted on opposite sides of housing 12. The constructions of hinges 80 and 80′ are identical as are the methods of mounting elastomeric members 78, 78′ to housing 12 by means of the hinges.

Figure 9:
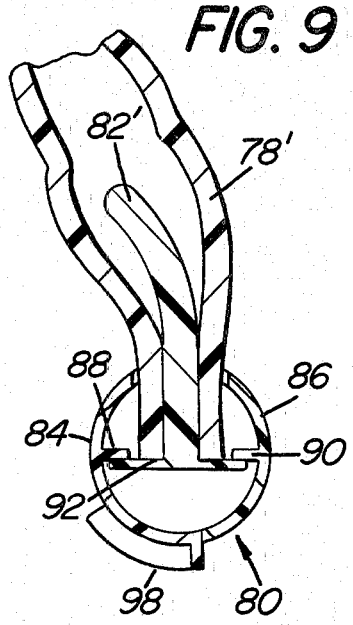
FIG. 9 is a cross-section of a hand-shaped elastomeric member and hinge.

The manner in which elastomeric member 78′ is secured to hinge 80′ is shown in detail in FIG. 9. Hinge 80′ comprises two sections 84 and 86 which are fastened together by screws. Sections 84 and 86 are provided with facing ribs 88 and 90, respectively. Preferably, connecting member 82' is made of a polymeric plastic material. The connecting member provides support for elastomeric member 78'. The connecting member is provided with an end panel 92 which is retained within the hinge 80' by the ribs 88 and 90. Elastomeric member 78 is secured to hinge 80 by means of connecting member 82 in the same fashion.

Hinges 80 and 80' are provided with arms 94 and 94', respectively. See FIG. 3. The arms 94 and 94' are coupled by means of springs 96 and 96' respectively to retainer 58. The springs 96 and 96' bias the elastomeric members 78 and 78' respectively in the open position wherein the face of the housing 12 is visible. See FIG. 1.

Figure 6:
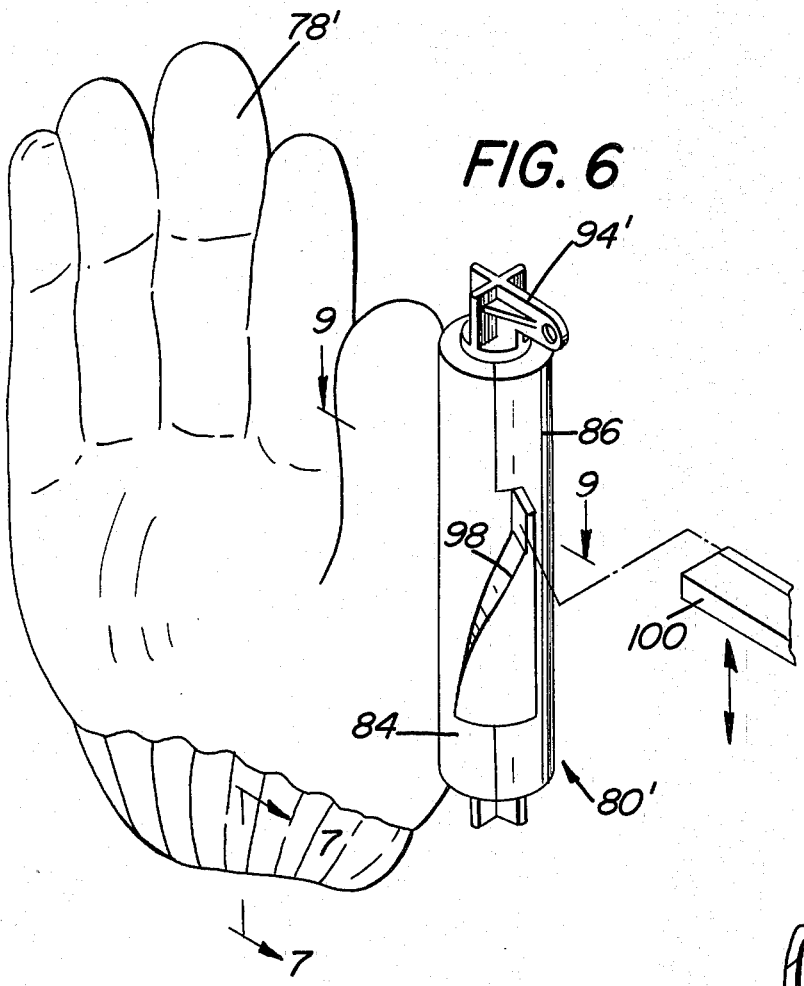
FIG. 6 is an isometric of the hand-shaped elastomeric member and cam follower.

The section 84 of hinge 80' is provided with a contoured projection 98. See FIG. 6. Contoured projection 98 abuts against a cam 100 on motive member 38. Vertical movement of the cam 100 over the contoured projection 98 produces rotational movement of the elastomeric member 80' due to the camming action between the cam and contoured projection. Specifically, when a child pulls the handle 64, the motive member 38 travels downwardly. Cam 100 is urged downwardly against projection 98, causing hinge 80' to rotate against the return force of spring 96'. See FIGS. 3 and 6. Accordingly, the elastomeric member 78' rotates into position in front of the face of housing 12. In this position, member 78' conceals the eye-shaped opening 18. When the child releases the handle 64, spring 42 snaps motive member 38 upwardly. Cam 100 is urged upwardly against projection 98, and spring 96' returns the hinge 80' to its original position. Accordingly, the elastomeric member 78' rotates back to the original open position. The sequence of movements of the elastomeric member simulates a peek-a-boo game.

Hinges 80 and 80' are symmetrical counterparts. The hinges function identically. Hinge 80 is provided with a contoured projection 102 which cooperates with a cam 104 on motive member 38. See FIG. 3. The cam and contoured projection to produce reciprocating rotational movement of elastomeric member 78 from an open position to a position in front of the face of housing 12 when handle 64 is pulled and released.

Figure 7:
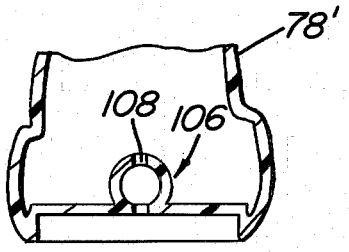
FIG. 7 is a cross-section taken along the lines 7—7 in FIG. 6.

Elastomeric member 78' has a molded portion 106 provided with a constricted passage 108 for producing a squeaking sound when the member is squeezed. See FIG. 7. Elastomeric member 78 is provided with an identical structure for producing a squeaking sound.

A bulb-shaped elastomeric nose member 110 made of material such as soft vinyl is seated in an opening 112 in the housing 12. See FIG. 4. The nose member 110 is secured in position by means of a cylindrical plug 114. The nose member 110 is provided with a molded portion 116 having a constricted passageway 118 for producing a squeaking sound when the member is squeezed.

A hat-shaped member 120 is rotatably mounted on the top of housing 12. See FIG. 4. The hat has a stem 122 provided with plural spaced paddles 124. The stem extends through a bushing 126 in an opening 128 in the housing. The bushing 126 is secured in position by a speednut 130. The bushing is provided with a pair of flexible fingers 132 which produce a clicking sound when contacted and released by paddles 124. A child rotates the hat 120 causing the paddles 124 to rotate and intermittently contact the fingers 132. By quickly turning the hat, the child can produce a rapid series of clicking noises.

In operation, the tie straps 28, 30 and 32 are wrapped around the horizontal and vertical bars of a crib to anchor the action toy 10 in position. The child manipulates the ridges 60, 60' to move eyelid-shaped shutters 52 or 52' respectively up and down to simulate the winking of an eye. The child pulls the handle 64 to produce a comical downward movement of the eyeball designs on cut-outs 46 and 46' while the hand-shaped members 78 and 78' rotate in front of the face of housing 12 to conceal the face as in a peek-a-boo game. When the child releases the handle 64, the hand-shaped members 78 and 78' return to their open positions wherein the face of housing 12 is visible. At the same time, the eyeball designs on cut-outs 46 and 46' re-appear. The child may also rotate the hand-shaped members 78 and 78' manually without using the handle 64. An audible sound may be created by squeezing the hand-shaped members 78, 78', squeezing the bulb-shaped nose member 110, or by spinning the hat 120.

The housing 12, motive member 38, back panel 20, handle 64, plates 34 and 34', and the hinges 80 and 80' may all be made of a polymeric plastic material. The hat 120 and bushing 126 may also be made of a polymeric plastic material. The action toy is sturdy, compact and portable. It is easily mounted on a child's crib. The toy is operated to simulate a peek-a-boo game by simply pulling and releasing the handle 64.

The present invention may be embodied in other specific forms without departing from the spirit or essential attributes thereof and, accordingly, reference should be made to the appended claims, rather than to the foregoing specification, as indicating the scope of the invention.

I claim:

1. An action toy, comprising:

a housing having at least one eye-shaped opening, a member bearing an eye-shaped design, said member being disposed within said housing in juxtaposition with said opening, at least one hand-shaped member rotatably mounted on said housing, and motive means connected to said member bearing said eye-shaped design, said motive means being disposed in operative relation with said hand-shaped member for causing simultaneous reciprocating rotational movement of said hand-shaped member and reciprocating translational movement of said member bearing said eye-shaped design in a plane spaced from the housing.

2. The action toy according to claim 1 including an eyelid-shaped shutter slideably mounted on said housing intermediate said opening and said member for reciprocating movement in juxtaposition with said opening.

3. The action toy according to claim 1 including at least one hinge rotatably mounted on said housing, said hand-shaped member being secured to said hinge, and said motive means and said hinge being spring coupled to said housing.

4. The action toy according to claim 3 wherein said motive means includes at least one cam member, and a handle at least partially disposed outside said housing, and wherein said hinge includes a contoured surface operatively associated with said cam member.

5. The action toy according to claim 1 including a bulb-shaped elastomeric nose member mounted on said housing, said elastomeric nose member having a constricted passage for producing a sound.

6. The action toy according to claim 1 wherein said hand-shaped member is elastomeric and is provided with a constricted passage for producing a sound.

7. The action toy according to claim 1 including a bushing secured to said housing, said bushing having at least one finger, and a hat-shaped member having a stem rotatably mounted in said bushing, said stem having at least one paddle for intermittently contacting said finger to produce a sound.

8. The action toy according to claim 1 wherein said eye-shaped design is a cut-out secured to said member bearing an eye-shaped design.

9. An action toy comprising:

a housing in the shape of a face, said housing having a pair of spaced eye-shaped openings, a pair of members, each of which bears an eyeball design, each of said members being disposed within said housing for translational movement in juxtaposition with said openings, a pair of hinges rotatably mounted on opposite sides of said housing, a pair of hand-shaped members secured to said hinges, and motive means connected to said members bearing said eyeball designs and disposed in cammed relation with said hinges for causing simultaneous reciprocating translational movement of said members bearing said eyeball designs and reciprocating rotational movement of said hand-shaped members.

10. The action toy according to claim 9 wherein said eyeball design is in the form of a cut-out.

11. The action toy according to claim 9 wherein each of said hand-shaped members is elastomeric and is provided with a constricted passage for producing a sound.

12. The action toy according to claim 9 wherein said motive means includes a pair of cams and each of said hinges includes a contoured surface operatively associated with one of said cams.

13. The action toy according to claim 9 wherein said motive means and said hinges are spring-coupled to said housing.

14. The action toy according to claim 9 wherein said motive means includes a handle at least partially disposed outside said housing.

15. The action toy according to claim 9 including a pair of eyelid-shaped shutters slideably mounted on said housing for reciprocating movement in juxtaposition with said spaced openings.

* * * * *